United States Patent [19]

Becker, III et al.

[11] 4,106,736

[45] Aug. 15, 1978

[54] ARTICLE SUPPORTING APPARATUS

[75] Inventors: Frederick R. Becker, III, Dallas; Charles W. Nicely, Wilkes-Barre, both of Pa.

[73] Assignee: Metropolitan Wire Corporation, Wilkes-Barre, Pa.

[21] Appl. No.: 756,397

[22] Filed: Jan. 3, 1977

[51] Int. Cl.[2] ..... A47F 5/01

[52] U.S. Cl. ..... 248/222.2; 211/103; 211/106; 248/311.1 R; 248/302

[58] Field of Search ..... 211/103, 106, 119, 181, 211/208; 248/220.2, 302, 310, 220.3, 311.1, 224.4, 303, 222.2, 222.3, 225.2

[56] References Cited

U.S. PATENT DOCUMENTS

| | | | |
|---|---|---|---|
| 2,990,066 | 6/1961 | Arnett | 211/106 |
| 3,115,252 | 12/1963 | Senical | 211/106 X |
| 3,167,287 | 1/1965 | Collins | 248/311.1 X |
| 3,295,471 | 1/1967 | Cook | 211/106 X |
| 3,391,891 | 7/1968 | Garden | 248/311.1 |
| 3,568,969 | 3/1971 | Boman et al. | 248/311.1 |
| 3,659,722 | 5/1972 | Carroll | 211/106 |
| 3,995,744 | 12/1976 | Metcalf | 211/181 X |

FOREIGN PATENT DOCUMENTS

| | | | |
|---|---|---|---|
| 1,478,879 | 3/1967 | France | 211/106 |

*Primary Examiner*—Roy D. Frazier
*Assistant Examiner*—Robert W. Gibson, Jr.
*Attorney, Agent, or Firm*—Friedman, Goodman & Teitelbaum

[57] ABSTRACT

An article supporting apparatus including a bracket which can be selectively placed and locked onto a supporting standard. A shelf, or other article holding device, is connected to the bracket. The bracket includes a U-shaped clip with transversely offset extending arms at the ends of the clip and longitudinally extending legs at the opposite ends of the arms. One of the legs includes an offset portion which lies in the same plane as the U-shaped clip. The standard includes three spaced apart bars positioned so that when the arms of the bracket sit on the middle bar, the bight of the U-shaped clip will be securely retained behind the upper bar and the legs of the bracket will straddle the lower bar. The bracket can be easily removed and repositioned at another location on the standard.

12 Claims, 7 Drawing Figures

ARTICLE SUPPORTING APPARATUS

BACKGROUND OF THE INVENTION

This invention relates to an article supporting apparatus and more particularly to a bracket with an article retaining device thereon, which bracket can be selectively positioned along a supporting standard.

There are readily available numerous article supporting means which can be selectively positioned. One such well known type of apparatus includes a pegboard having a plurality of spaced apart apertures, and clips which can be positioned in the apertures to be retained on the pegboard. Articles are then held by the clips by having a shelf, or other type of support connected to the clips. However, there is a tendency for the clips to fall out of the apertures on the pegboard, especially when supporting heavy loads. Accordingly, numerous types of devices have been suggested to lock the clips into the pegboards to prevent their falling out.

Other types of article supporting apparatus include standards with elongated openings for use with shelf brackets having hooks insertable in the openings. At least two such standards are spaced apart with brackets inserted at a desired position along the standards and a shelf placed on the brackets. However, this type of supporting apparatus is limited to using conventional shelves and cannot be readily altered to accommodate other types of holding means such as a retaining pocket, a magazine rack, a bottle holder, etc. Additionally, at least two, if not more, such standards must be utilized to provide the necessary support for the shelf.

Accordingly, there is a need for an article supporting apparatus which can be easily positioned at various locations and which can be securely locked into place to be able to support articles without fear of the bracket falling off the standard. Additionally, the apparatus should be adaptable to support numerous types and designs of shelves and other article supporting devices, including bottle holders, articles containers and the like.

SUMMARY OF THE INVENTION

An object of the present invention is to provide an article supporting apparatus which avoids the aforementioned problems of prior art devices.

A further object of the present invention is to provide an article supporting apparatus including a bracket which can be selectively positioned along a supporting standard.

Yet a further object of the present invention is to provide an article supporting apparatus including bracket means which can be securely locked into position on a standard.

Another object of the present invention is to provide an article supporting apparatus which includes a selectively positionable bracket along a standard, wherein any of numerous types of article retaining devices can be coupled to the bracket.

Still a further object of the present invention is to provide an article supporting apparatus which includes bracket means which can be selectively locked into position on standard means such that the bracket means is prevented from movement or lateral play, and further provides a flat front surface to which can be connected an article retaining device.

Another object of the present invention is to provide an article supporting apparatus which is inexpensive to produce, easy to manipulate, readily installable, and provides a secure support.

Briefly, the article supporting apparatus includes bracket means in the form of a U-shaped clip which has a longitudinal axis lying in a first plane. A pair of offset parallel arms extend from the ends of the U-shaped clip and lie in a second plane substantially perpendicular to the first plane. A pair of legs extend longitudinally from the arms and lie in a third plane substantially parallel to the first plane. The article supporting apparatus also includes a standard means having an elongated pair of laterally spaced apart rods and at least two spaced apart transverse bars connected to the rods and adapted to accommodate and retain the bracket means. An article support means is coupled to the pair of legs of the bracket means.

In an embodiment of the invention, one leg of the bracket means includes an offset end portion which lies in the first plane, and further includes an interconnecting portion between the offset end portion and the main portion of the leg. The standard includes three spaced apart transverse bars positioned such that when the arms of the bracket means sit on the intermediate bar, the U-shaped clip is securely retained behind the upper bar and the legs straddle the lower bar.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings like reference characters designate like parts.

DESCRIPTION OF THE PREFERRED EMBODIMENT

Figure 1:
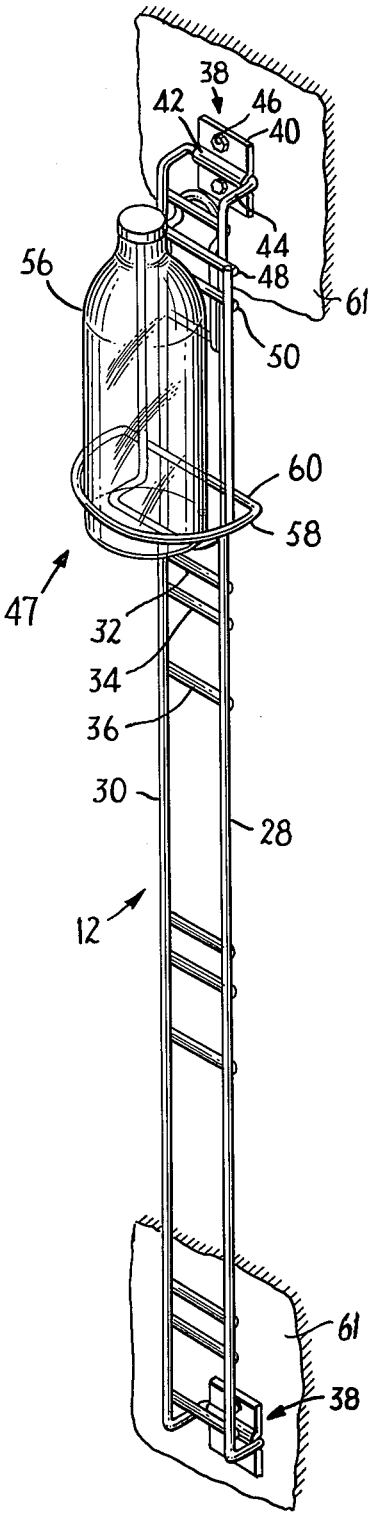
FIG. 1 is a perspective side view of the article supporting apparatus of the present invention.
Figure 2:
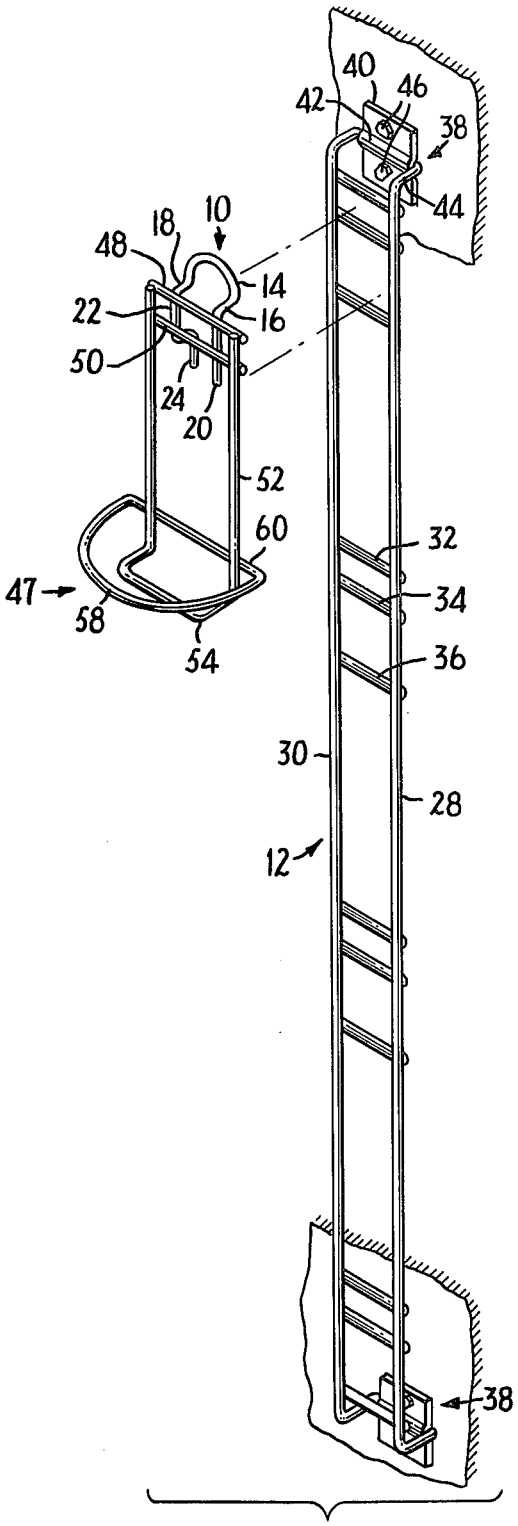
FIG. 2 is a perspective view of the article supporting apparatus showing the bracket means separated from the standard means.
Figure 3:
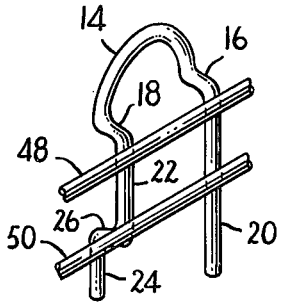
FIG. 3 is a fragmentary perspective view of the bracket.

Referring now to the drawings, the article supporting apparatus includes a bracket, generally referred to at 10, which can be selectively inserted in any of the various locations along a standard, shown generally at 12. The bracket 10 includes a U-shaped clip 14 having a longitudinal axis lying in a first vertical plane. A pair of transversely extending offset arms 16, 18 extend in a parallel relationship from the ends of the U-shaped clip and lie in a second horizontal plane which is substantially perpendicular to the first plane. A pair of longitudinally extending legs 20, 22 lie in a third vertical plane which is substantially parallel to the first plane.

On of the legs, shown as leg 22, includes an offset end portion 24 which lies in substantially the same plane as the first plane. An interconnecting portion 26 is positioned between the offset end portion 24 and the main part of the leg 22.

The standard includes an elongated pair of parallel laterally spaced apart rods 28, 30 with three transverse bars 32, 34 and 36, connected across the rods to accommodate and retain the bracket. The group of three rods is shown repeated at intervals along the rods, each of the groups of bars establishing a respective location to which the bracket can be connected. The bars are shown connected to the rear part of the rods.

The standard is shown with mounting devices 38 placed at the top and bottom ends of the standard to securely connect the standard to a conventional support surface 61, such as a wall and the like. The mounting device includes a mounting plate 40 having a transverse sleeve or recess 42 through which the upper end of the standard can pivotally pass. The top of the standard has a horizontally extending bent section 44 permitting the standard to be spaced from the support surface 61. Bolts 46 firmly connect the mounting plate 40 to the support surface.

An article supporting device, shown generally at 47 is connected to the legs 20, 22 of the bracket. By way of example, the article supporting means is shown as a bottle holder and includes connecting rods 48, 50 transversely connected across the legs 20, 22 and supporting a frame 52 having downwardly extending legs bent to form a base portion 54 on which the bottle 56 can be placed. A curved retaining member 58 is connected to the frame 52 by means of the transverse bar 60 at the rear of the frame 52. It is understood however, that any other type of article support means could also be utilized by merely connecting it to the legs 20, 22 of the bracket.

The three bars 32, 34 and 36 are spaced apart such that when the arms 16, 18 of the bracket sit upon the middle bar 34, the top portion or bight of the U-shaped clip will be securely retained behind the upper bar 32, while the leg 20 and the portion 24 of the leg 22 will securely straddle the lower bar 36. In order to better achieve such positioning, the longitudinal spacing between the first two bars 32, 34 is made less than the height of the U-shaped clip 14 as measured from its top most part to its ends under the arms 16, 18. The spacing between the second and the third bars 34, 36 is made less than the longitudinal distance from the lower ends of the U-shaped clip 14 to the end of the leg portion 24. The spacing between the top bar 32 and the lower bar 36 is made greater than the distance from the lower ends of the U-shaped clip to the end of the offset leg 24. The reason for these measurements will be made clear as set forth below.

The thickness of the bars 32, 34 and 36 are made substantially equal to the distance between the first and third planes, which would be approximate to the staddle space between the leg 20 and the leg portion 24, and approximate to the length of the offset arms 16, 18. The lateral spacing of the rods 28, 30 is slightly greater than the width of the bracket, so that the bracket can fit between the laterally spaced rods and be snugly retained by them to prevent lateral movement of the bracket when locked in place.

Figure 4:
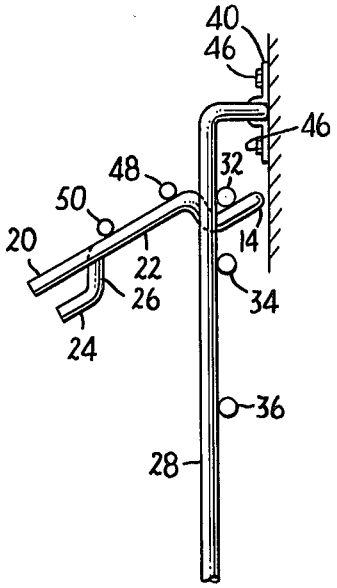
FIGS. 4, 5 and 6 show side views of the apparatus and demonstrate the sequence of steps in mounting and locking the bracket onto the standard.
Figure 5:
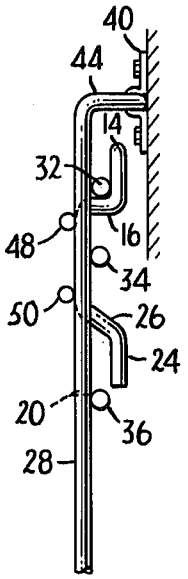
Figure 6:
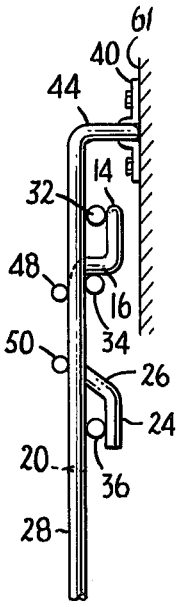
Figure 7:
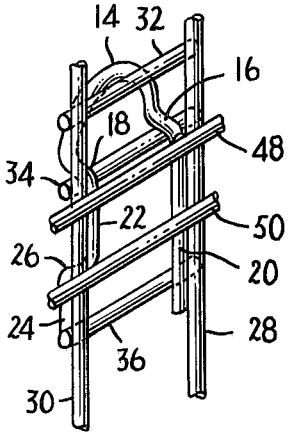
FIG. 7 is a front perspective view of the bracket locked in place on the standard.

The bracket is inserted into the standard as shown in FIGS. 4–6. Initially, the U-shaped clip 14 is angularly inserted between the upper outer bar 32 and the middle or intermediate bar 34. The bracket is then swung downwardly toward the standard with the arms 16, 18 sliding beneath the upper bar 32 until the legs 20, 22 hit the middle bar 34. The bracket is then pressed down, for example by pushing down on the top of the U-shaped clip 14, until the arms 16, 18 firmly rest on the middle bar 34. The leg 20 and leg portion 24 will then snugly straddle the lower outer bar 36. At the same time, the top or bight of the U-shaped clip 14 will be snugly retained behind the upper bar 32. between the three bars 32, 34 and 36, and cannot twist or bend out ot its position. Furthermore, because the lateral spacing of the rods 28, 30 are only slightly greater than the width of the bracket, there will hardly be any lateral movement of the bracket as well. By placing the bars 32, 34, 36 on the rear side of the rods 28, 30, when the bracket is inserted, the legs 20, 22 of the bracket will lie in the same plane as the rods 28, 30 of the standard. In this way, the bracket will not protrude from the front of the standard and the entire bracket and standard will present a flush front on which the article support means can be connected by means of the rods 48, 50. In order to provide sufficient room for the bars and bracket, the standard is spaced from the support surface 61 by means of the lateral extension 44 of the top and bottom of the standard. To simplify the production of the bracket, standard and article support means, all of the parts can be made of uniform cross-sectioned rods which are precut and shaped to the size as needed. The bars and the article support means can be connected by welding, soldering, or any other well known fastening process.

Although the bracket described included an offset leg to straddle the third bar, it will be evident that the bracket can be formed without the offset with both legs downwardly extending and parallel to each other. With such arrangement, only two bars are needed, specifically the bars 32 and 34. The U-shaped clip can then be inserted, as shown in FIG. 4, and the bracket rotated to have the arms 16, 18 resting on the legs 24. The bracket will then remain in place by having the top of the U-shaped clip 14 held behind the upper bar 32 with the legs prevented from lateral movement by means of the rods 28, 30. However, the bracket will be retained by the standard and held in place by the weight of the article support means.

In order to facilitate the locking of the bracket on the standard, one of the legs, and specifically the leg containing the offset 24, is made shorter than the other leg 20. This can best be seen in FIG. 4. By making the leg shorter, as the bracket is pivoted into position as shown in FIG. 5, the shorter leg will pass by the lower bar 36 while the longer leg 20 will hit the lower bar 36 and prevent any further movement past the bar 36. It will then be easy to push down on the bracket and have the two legs straddle the bar 36 since they are already positioned in their proper place with one leg in front and one behind the bar 36.

Typically, the article supporting apparatus can be made of strong material such as solid steel rods, or can be made of tubing, such as aluminum tubes, or other such material.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. An article supporting apparatus comprising the combination of:

(a) a bracket member including a U-shaped clip portion having a longitudinal axis lying in a first plane, a pair of parallel offset arms extending from respective ends of said U-shaped clip portion and lying in a second plane substantially perpendicular to said first plane, and a pair of legs extending longitudinally from a respective one of said arms and lying in a third plane substantially parallel to said first plane;

(b) a standard member having rod means for preventing lateral movement of said legs, said rod means including an elongated pair of laterally spaced apart rods, and at least two longitudinally spaced apart transverse bars connected to rear sides of said rods to accommodate and retain said bracket member;

(c) article support means coupled to said legs of said bracket member;

(d) the longitudinal spacing between said bars being less than longitudinal length of said clip portion to provide for a part of said clip portion being retained behind one of said bars when said arms sit on the other of said bars in a retained position; and (e) the lateral spacing between said rods being slightly greater than width of said bracket member to receive said legs therein, said rods lying in said third plane in said retained position with said legs positioned inwardly of and adjacent to said rods to prevent said lateral movement of said legs.

2. An apparatus as in claim 1 and wherein said bracket member and said standard member are formed of uniform cross-sectioned cylindrical material.

3. An apparatus as in claim 1 and wherein said article support means includes connecting rods transversely coupled to said pair of legs, frame means supported from said connecting rods, and an article retaining member connected to and outwardly extending from said frame means.

4. An article supporting apparatus comprising the combination of:

(a) bracket means including a U-shaped clip having a longitudinal axis lying in a first plane, a pair of parallel offset arms extending from respective ends of said U-shaped clip and lying in a second plane substantially perpendicular to said first plane, and a pair of legs, each of said legs extending longitudinally from a respective one of said arms and lying in a third plane substantially parallel to said first plane, one of said legs including an offset end portion lying in said first plane with an interconnecting portion disposed between said offset end portion and a main part of said one leg;

(b) standard means having an elongated pair of laterally spaced apart rods, and at least three longitudinally spaced apart transverse bars connected to said rods to define a middle bar disposed between two outer bars, said three bars being positioned for said arms of said bracket means to sit on said middle bar with said clip being retained by one of said outer bars and said legs straddling the other outer third bar to accomodate and retain said bracket means; and (c) article support means coupled to said pair of legs of said bracket means.

5. An apparatus as in claim 4 and wherein the lateral spacing of said rods is slightly greater than the width of said bracket means, said bracket means being prevented by said rods from excessive lateral movement when said arms sit on said middle bar

6. An apparatus as in claim 5 and wherein said bars are connected to rear sides of said rods, whereby when said arms sit on said middle bar with the bracket facing said standard, said rods lie in said third plane with said legs positioned inwardly of and adjacent to said rods.

7. An apparatus as in claim 4 and wherein said three bars are repeatedly positioned at longitudinally spaced apart intervals along said rods.

8. An apparatus as in claim 7 and wherein said standard means further comprises mounting brackets to connect said standard means to a support surface.

9. An apparatus as in claim 8 and wherein said standard means includes a bent end to which is coupled said mounting bracket to space the standard means from the support surface.

10. An apparatus as in claim 4 and wherein the longitudinal spacing between said one outer bar and said middle bar is less than the longitudinal length of said U-shaped clip, the spacing between said middle bar and said outer third bar is less than the longitudinal distance from the ends of the U-shaped clip to free ends of said legs, and the spacing between said two outer bars is greater than the distance from the ends of the U-shaped clip to a free end of said offset end portion.

11. An apparatus as in claim 10 and wherein said one and the other legs are of unequal length, the length of said other leg being such that the longitudinal distance from the ends of the U-shaped clip to a free end of said other leg is greater than the spacing between the two outer bars.

12. An apparatus as in claim 10 and wherein the thickness of said bars is substantially equal to the distance between said first and third planes.

* * * * *